US008736450B2

(12) United States Patent
Brown et al.

(10) Patent No.: US 8,736,450 B2
(45) Date of Patent: May 27, 2014

(54) THEFT DETERRENT DEVICE

(75) Inventors: Douglas S. Brown, Charlotte, NC (US); John F. Kelley, Clarkesville, GA (US); Todd Seager, Orem, UT (US)

(73) Assignee: International Business Machines Corporation, Armonk, NY (US)

( * ) Notice: Subject to any disclaimer, the term of this patent is extended or adjusted under 35 U.S.C. 154(b) by 155 days.

(21) Appl. No.: 13/439,204

(22) Filed: Apr. 4, 2012

(65) Prior Publication Data

US 2013/0265164 A1 Oct. 10, 2013

(51) Int. Cl.
*G08B 13/12* (2006.01)

(52) U.S. Cl.
USPC ..... 340/568.2; 340/541; 70/57.1; 248/65; 292/318; 24/3.13

(58) Field of Classification Search
USPC ..... 340/568.1–568.8, 540, 541, 542, 548, 340/571, 593, 596; 70/57, 57.1, 58, 14; 292/318; 248/65; 24/3.1, 3.13
See application file for complete search history.

(56) References Cited

U.S. PATENT DOCUMENTS

| | | | | |
|---|---|---|---|---|
| 5,418,521 | A | 5/1995 | Read | |
| 5,525,965 | A | 6/1996 | Liebenthal | |
| 6,150,940 | A * | 11/2000 | Chapman et al. | 340/568.3 |
| 6,536,815 | B1 * | 3/2003 | Liroff | 292/259 R |
| 7,079,032 | B2 | 7/2006 | Merrem et al. | |
| 7,446,659 | B2 * | 11/2008 | Marsilio et al. | 340/568.1 |
| 7,710,266 | B2 * | 5/2010 | Belden et al. | 340/568.3 |
| 8,368,536 | B2 * | 2/2013 | Fawcett et al. | 340/568.1 |
| 2003/0206495 | A1 * | 11/2003 | Kibiloski et al. | 368/84 |
| 2005/0174238 | A1 | 8/2005 | Foseide | |

OTHER PUBLICATIONS

"Lock Alarm Mini—2 ft cable by Corporate Travel Safety—Laptop Security Gear—Corporate Travel Safety.com", Copyright © 2010 Corporate Travel Safety, LLC, dated printed Jan. 26, 2012 <http://www.corporatetravelsafety.com/catalog/lock-alarm-mini-cable-p-263.html>.

* cited by examiner

*Primary Examiner* — George Bugg
*Assistant Examiner* — Edny Labbees
(74) *Attorney, Agent, or Firm* — Arnold Bangali; Arthur Samodovitz

(57) ABSTRACT

An apparatus to deter theft of a movable product is provided. In one aspect, the apparatus comprises a housing, a plug connected to the housing to insert into an electrical socket to receive power, a bracket connected to the housing and having an opening to receive a locking cable while the opening of the bracket protrudes from the housing. A switch, within the housing, responsive to protrusion of the opening of the bracket from the housing to receive the locking cable. An electrical circuitry, within the housing, responsive to the switch being in a first state, and absence of power at the plug to sound an alarm, and responsive to the switch being in a second state or the presence of power at the plug to prevent sounding of the alarm.

12 Claims, 5 Drawing Sheets

THEFT DETERRENT DEVICE

FIELD OF THE INVENTION

The present invention relates generally to a theft deterrent device and more specifically to a theft deterrent device to which a valuable product can be secured.

BACKGROUND

Laptop computers are portable and have the same capacity and software as many large desktop computers. In addition, laptops allow connectivity, even outside the office, thus freeing people to take their workplace with them. The portability of laptops is valuable to employees and also personal users who must travel frequently while remaining in continual communication with their homes or offices. However, unattended laptop computers are prone to theft.

Other types of products such as suitcases, purses, briefcases, computer cases, and other products commonly carried during travel are prone to theft. Conventional luggage may be closed with a lock to prevent an unauthorized person from readily opening the luggage, but that does not prevent theft and subsequent opening of the luggage in a private location.

Currently, many styles of security device have been developed to address the theft of devices. For example, U.S. Pat. No. 5,552,965 describes a device to prevent theft of electrical appliances in which an electrical plug of the electrical appliance is plugged in and secured within the theft prevention device. The theft prevention device is plugged into a wall outlet or power strip and also powers the electrical appliance. The theft prevention device incorporates an internal power source, such as a battery, and an alarm which will be activated if the theft prevention device is unplugged from the electrical outlet. U.S. Pat. No. 7,079,032 describes a theft protection plug which is mounted externally on electrical devices. The theft protection plug includes an anti theft alarm device which is incorporated into the plug to protect the electrical device against theft. The theft protection plug allows the anti theft alarm device to change signal by utilizing a motion sensor to change signal states when an attempt is made to disconnect the theft protection plug from the electrical device. Responsive to the change signal state, the alarm emits sound.

SUMMARY

Aspects of the present invention disclose an apparatus to deter theft of a movable product, the apparatus comprising, a housing, a plug connected to the housing to insert into an electrical socket to receive AC power, a bracket connected to the housing and having an opening to receive a locking cable while the opening of the bracket protrudes from the housing, a switch, within the housing, responsive to protrusion of the opening of the bracket from the housing to receive the locking cable, to exhibit a first state and responsive to the opening of the bracket being substantially contained in the housing, to exhibit a second, opposite state, electrical circuitry, within the housing, responsive to the switch being in the first state, and absence of AC power at the plug to sound an alarm, and responsive to the switch being in the second state or the presence of AC power at the plug to prevent sounding of the alarm.

BRIEF DESCRIPTION OF THE SEVERAL VIEWS OF THE DRAWINGS

Novel characteristics of the invention are set forth in the appended claims. The invention itself, however, as well as a preferred mode of use, further objectives, and advantages thereof, will be best understood by reference to the following detailed description of the invention when read in conjunction with the accompanying figures, wherein like reference numerals indicate like components, and:

DETAILED DESCRIPTION

Figure 1:
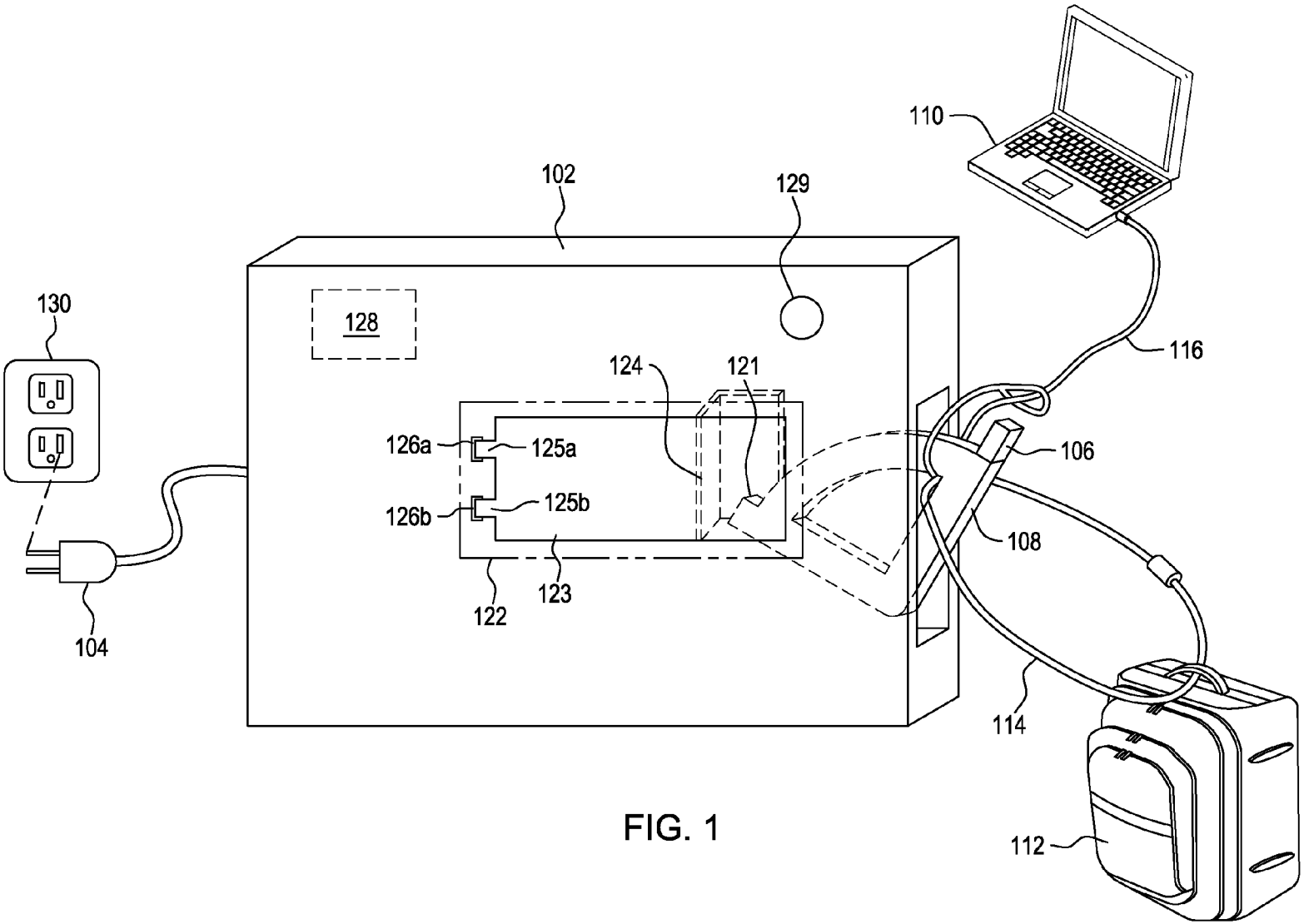
FIG. 1 illustrates a theft deterrent device in an armed i.e., active alarm state in accordance with an embodiment of the present invention, and various products protected by the theft deterrent device.

The present invention will now be described in detail with reference to the figures. FIG. 1 illustrates a theft deterrent device 102 for movable products 110 or 112, such as laptops, tablets, netbooks personal computers, smart phones such as a Blackberry®, luggage, purses, briefcases, computer cases and furniture. FIG. 1 depicts the theft deterrent device 102 in an armed i.e., active alarm state.

The theft deterrent device 102 plugs into an electrical socket 130 to deter theft of the movable products 110 or 112. A bracket 108 (with an interior opening) and a tab 106 protrude from the theft deterrent device 102 such that the opening in the bracket can receive a locking cable. The theft deterrent device 102 also includes a microswitch (illustrated in FIG. 3) that operates to detect if tab 106 is pulled out from the theft deterrent device 102. If the tab 106 is pulled out from the theft deterrent device 102, bracket 108 to which tab 106 is attached protrudes from the theft deterrent device 102 to receive a locking cable 114 or 116 that is secured to movable product 112 or 110, respectively.

In addition, if tab 106 is pulled out and kept out by virtue of having the locking cable 114 inserted through the opening in the bracket 108, the theft deterrent device 102 activates into the active alarm state (as described below), and a protrusion 121 of bracket 108 blocks removal of a door 123 for battery compartment 122 such that door is mechanically locked in place. More specifically, the door 123 has an inner wing 124, and, in the active alarm state, the protrusion 121 is interposed between the inner wing 124 and the outer exposed wall of the door 123 such that the protrusion prevents the inner wing 124 (and door 123 to which it is attached) from being removed. At an opposite side of the door 123, curved tabs 125*a,b* are received in mating slots 126*a,b* to prevent this end of the door 123 from being opened during the active alarm state.

Theft deterrent device 102 further includes a visible alarm 129 and an internal audible alarm 128 which are activated (for example, to flash) upon removal of plug 104 from electrical socket 130, as described below. In addition, the visible alarm 129 displays a warning (such as a constant light) when the theft deterrent device 102 is armed.

The theft deterrent device 102 also includes a power detection circuit (illustrated in FIG. 4 and described below) to detect loss of power from electrical socket 130 if plug 104 is removed from electrical socket 130 while the device is armed. Responsive to detection of loss of power from electrical socket 130, the theft deterrent device 102 activates visible alarm 129 and internal audible alarm 128 to emit an alarm-type sound. The visible alarm 129 can be an LED or a strobe light, and in addition to the visual and internal audible alarms, a text message can be sent to a cell phone of the owner of the product that the alarm has been activated.

Figure 2:
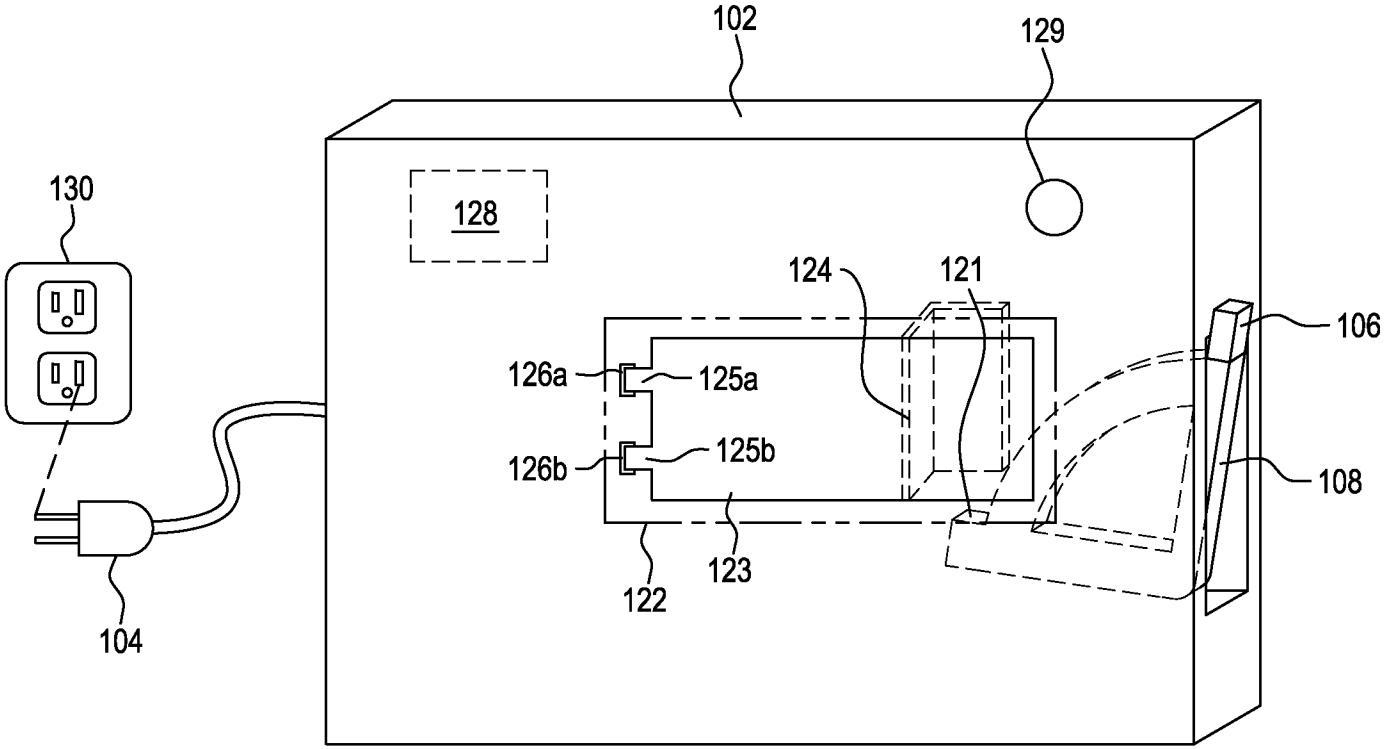
FIG. 2 illustrates the theft deterrent device of FIG. 1 in a disarmed, i.e., inactive alarm state.

FIG. 2 illustrates the theft deterrent device of FIG. 1 in a disarmed, i.e., inactive alarm state.

The theft deterrent device 102 is disarmed when tab 106 is retracted into the theft deterrent device 102. In this orientation, bracket 108 in FIG. 1 does not protrude from the theft deterrent device 102 and the opening in the bracket 108 is not exposed to insert a locking cable 114 or 116.

Theft deterrent device 102 is in an inactive alarm state only after locking cable 114 or 116 is removed from bracket 108. Thus, locking cable 114 or 116 can also operate to prevent bracket 108 from retracting back into the theft deterrent device 102 by mechanically interfering with travel of the bracket 108 into the theft deterrent device 102.

Figure 3:
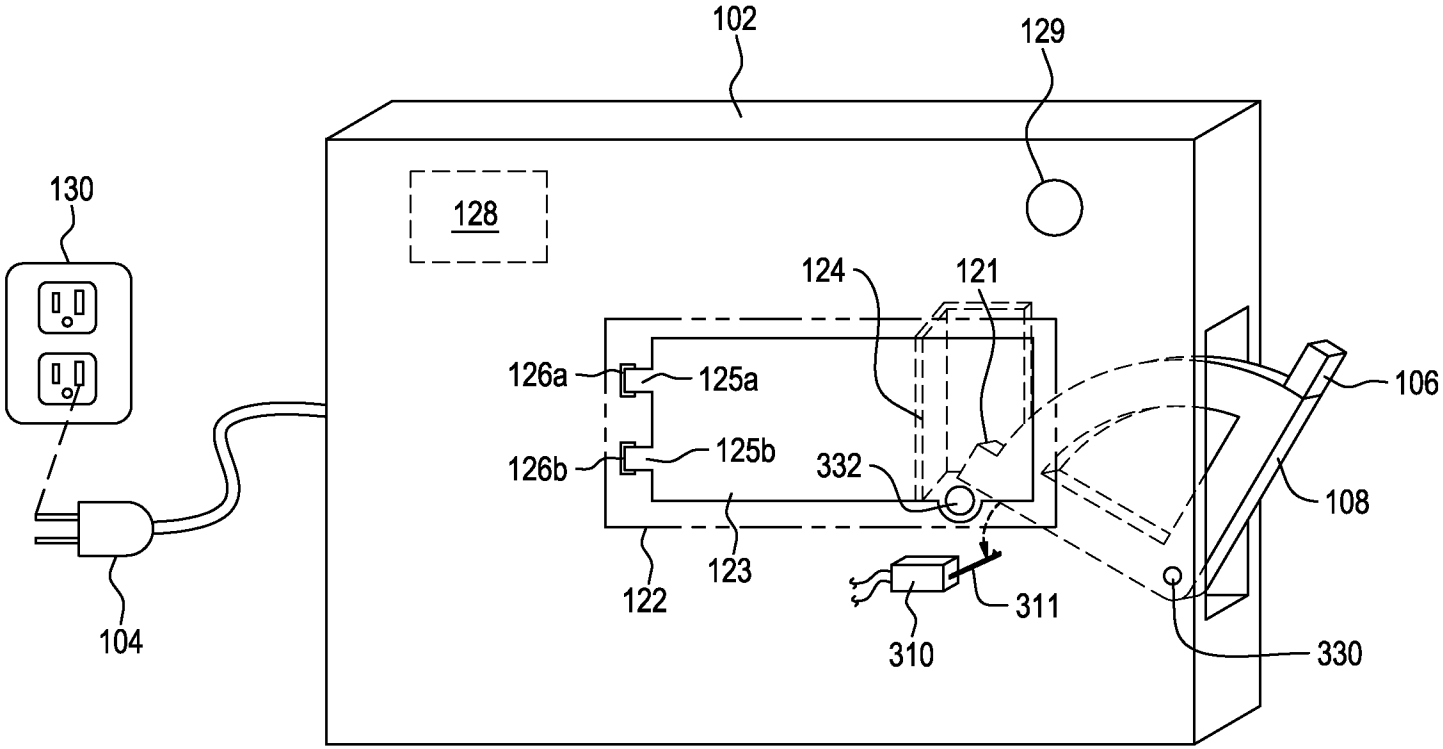
FIG. 3 is a plain view illustrating a bracket and tab of the theft deterrent device of FIG. 1 in the armed state where the bracket and tab are pulled-out of the theft deterrent device.

FIG. 3 is a plain view illustrating bracket 108 and tab 106 of the theft deterrent device of FIG. 1 in the armed state where the bracket and tab are pulled-out of the theft deterrent device. Bracket 108 includes a spring 330 which biases the bracket to the retracted position. Microswitch 310 is an electric switch that is biased to the closed (up as illustrated) position when tab 106 is pulled out of theft deterrent device 102 and protrusion 121 ceases to force the switch arm 311 in the open (down) position. Responsive to the actuation of microswitch 310, theft deterrent device 102 activates into an armed alarm state.

In addition, when tab 106 is pulled out and thus microswitch 310 is actuated, tab 106 pivots on pin 332 behind door 123 to lock the battery compartment 122 to prevent the battery compartment 122 from being opened while the theft deterrent device 102 is armed.

Figure 4:
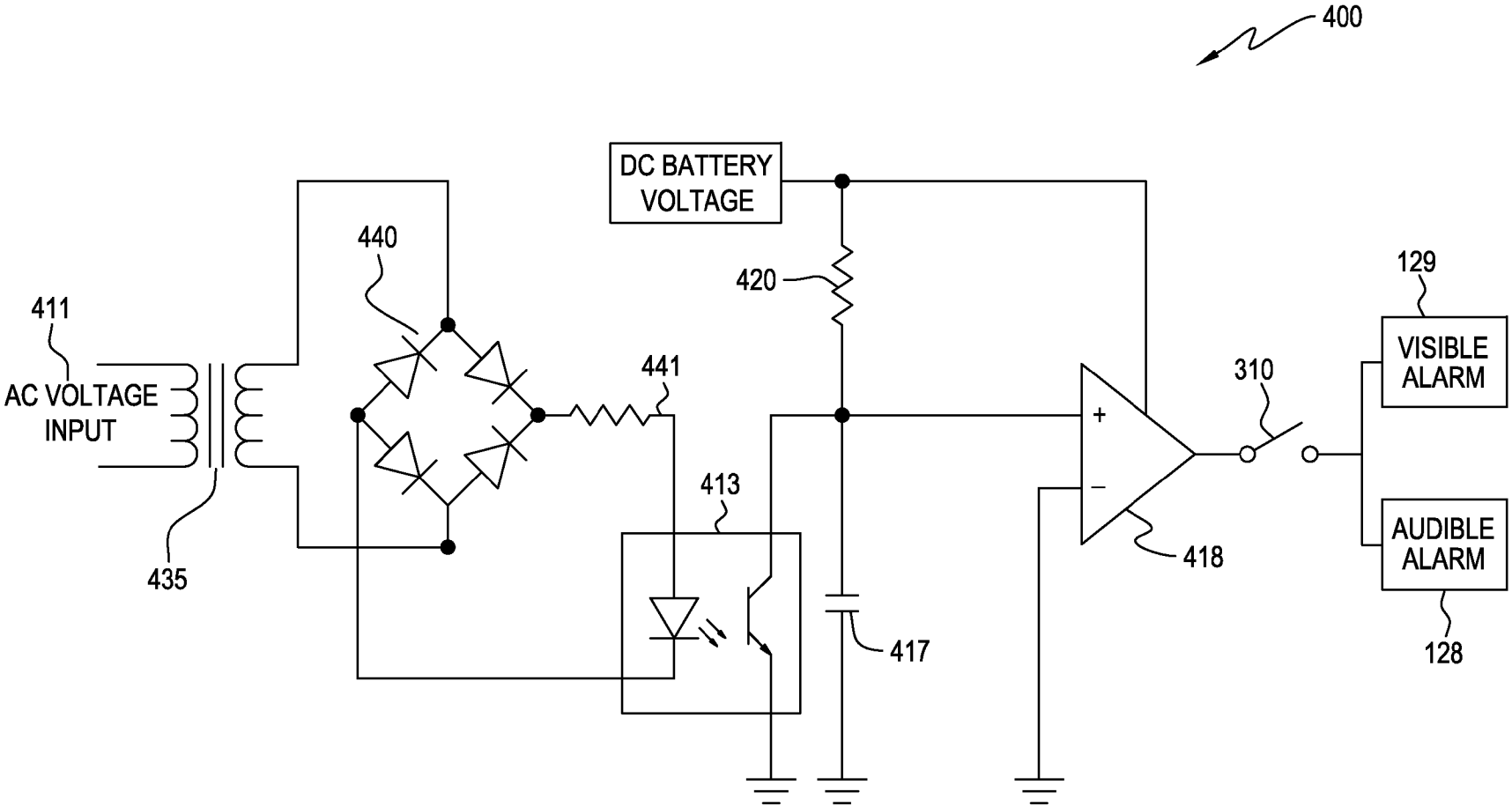
FIG. 4 illustrates a power detection circuit adapted to activate visible and internal audible alarms on the theft deterrent device of FIG. 1 when the theft deterrent device is armed and unplugged from an AC power source.

FIG. 4 illustrates a power detection circuit 400 adapted to activate visible and internal audible alarms on the theft deterrent device of FIG. 1.

Power detection circuit 400 is adapted to detect power from alternating current (AC) voltage 411 provided to the theft deterrent device 102 by the electric socket 130 in FIG. 1. A transformer 435 steps-down AC voltage 411 to approximately five Volts RMS, and a full wave rectification bridge 440 generates a corresponding full wave rectifying voltage 441. This triggers the opto-coupler 413 which drives a non-inverting amplifier 418. While AC power is applied to plug 130, the input to non-inverting amplifier 418 is low because capacitor 417 is discharged through the transistor-collector output of opto-coupler 413, and the output of non-inverting amplifier 418 is low as well. Conversely, when AC power is not applied to plug 130, the opto-coupler 413 is not triggered and the input to non-inverting amplifier 418 is high (due to pull-up resistor 420) and the output of non-inverting amplifier 418 is high as well. Microswitch 310 is interposed between the output of amplifier 418 and the visible alarm and audible alarm, such that no alarm will be triggered if either the switch is open, i.e., tab 106 is retracted or AC power is applied to bridge 440. However, if the plug 104 is removed from socket 130 and the switch is closed (by pulling out the tab), the AC input to bridge 440 terminates, the opto-coupler 413 is no longer triggered, and the input to the non-amplifier is pulled up to the DC battery voltage. This renders the output of amplifier 418 to the high output, which drives/activates the alarms via the closed microswitch 310.

Figure 5:
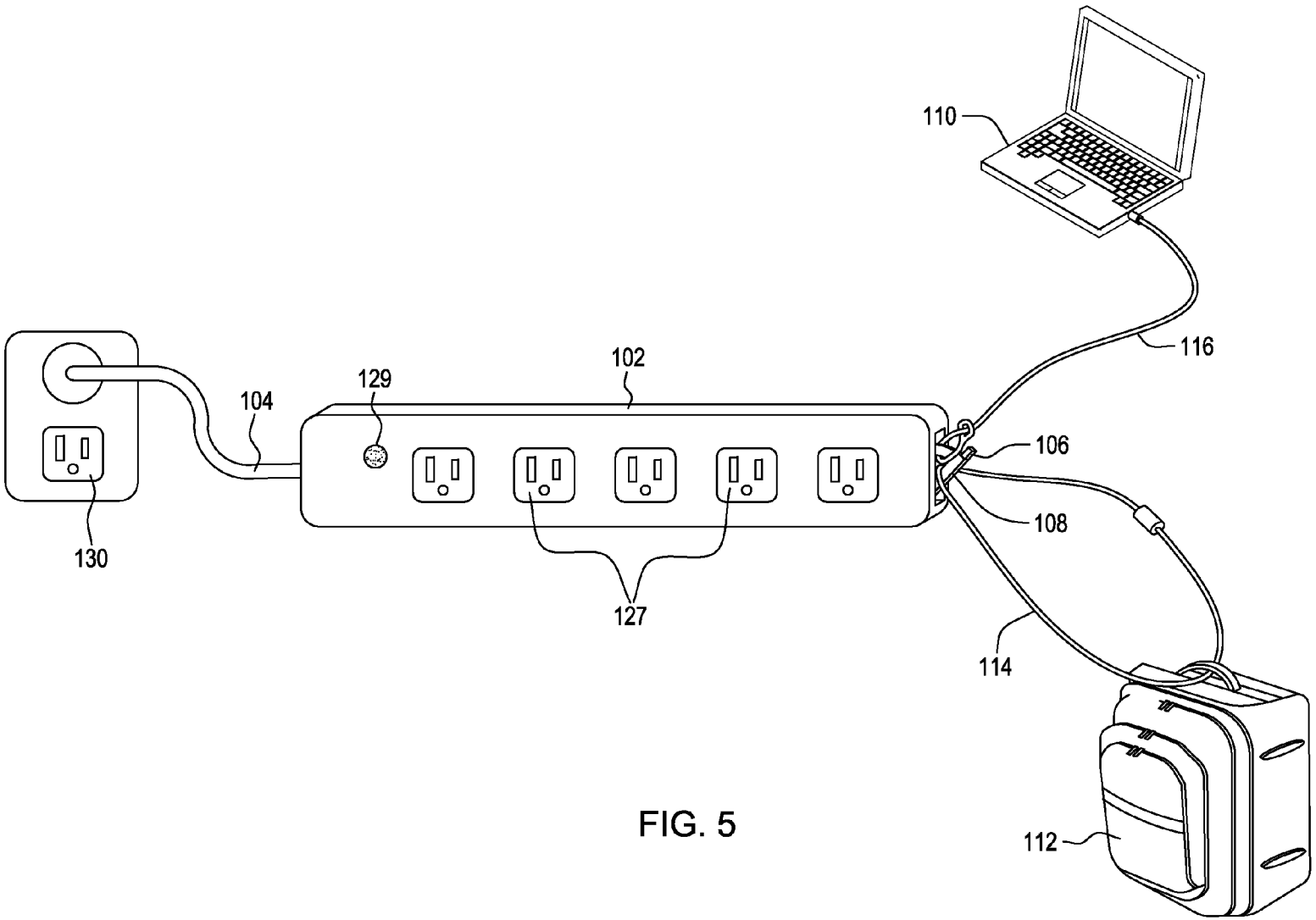
FIG. 5 illustrates an alternative embodiment of the theft deterrent device of FIG. 1.

FIG. 5 illustrates an alternative embodiment of the theft deterrent device of FIG. 1.

While not required to protect the movable product against theft, the theft deterrent device 102 optionally includes electrical outlets 127 which are electronically connected to electrical socket 130, as general purpose sockets.

Based on the foregoing, an apparatus for deterring theft of a movable product has been disclosed. However, numerous modifications and substitutions can be made without deviating from the scope of the present invention. For example, if the full wave rectifying bridge 440 and opto-coupler 413 can withstand the magnitude of the AC input voltage, then there is no need for the transformer 435. Therefore, the present invention has been disclosed by way of illustration and not limitation, and reference should be made to the following claims to determine the scope of the present invention.

What is claimed is:

1. An apparatus to deter theft of a movable product, the apparatus comprising:

a housing;

a plug connected to the housing to insert into an electrical socket to receive AC power, a bracket connected to the housing and having an opening to receive a locking cable while the opening of the bracket protrudes from the housing;

a switch, within the housing, responsive to protrusion of the opening of the bracket from the housing to receive the locking cable, to exhibit a first state and responsive to the opening of the bracket being substantially contained in the housing, to exhibit a second, opposite state; and electrical circuitry, within the housing, responsive to the switch being in the first state, and absence of AC power at the plug to sound an alarm, and responsive to the switch being in the second state or the presence of AC power at the plug to prevent sounding of the alarm.

2. The apparatus of claim 1, further comprising:

a battery compartment with a door to permit installation of a battery which powers the electrical circuitry in the absence of AC power at the plug.

3. The apparatus of claim 1, wherein the bracket receives the locking cable while the opening of the bracket protrudes from the housing and the switch exhibits the first state, and the bracket is retractable into the housing after the removal of the cable from the opening in the bracket to cause the switch to exhibit the second state.

4. The apparatus of claim 1, wherein the switch further comprises a mechanical linkage responsive to the protrusion of the opening of the bracket from the housing to lock a door of a battery compartment of the housing so the battery cannot be removed.

5. The apparatus of claim 1, wherein the bracket includes a tab which protrudes from the housing to enable a user to pull the bracket out of the housing to expose the opening in the bracket.

6. The apparatus of claim 1, wherein the electrical circuitry, responsive to the switch being in the first state and presence of AC power at the plug, indicates an armed state of the alarm.

7. A method for deterring theft of a movable property, the method comprising:

a circuit arming an alarm of an apparatus responsive to a moveable property being mechanically secured to the apparatus;

the circuit detecting an interruption of AC power to the circuit while the moveable property is mechanically secured to the apparatus; and responsive to detecting the interruption while the moveable property is mechanically secured to the apparatus, the circuit activating the alarm, wherein a bracket connected to the apparatus has an opening to receive a locking cable while the opening of the bracket protrudes from the apparatus, and wherein a switch, within the apparatus is responsive to protrusion of the opening of the bracket from the apparatus to receive the locking cable, to exhibit a first state and responsive to the opening of the bracket being substantially contained in the housing, to exhibit a second, opposite state.

8. The method according to claim 7, wherein the bracket receives the locking cable while the opening of the bracket protrudes from the apparatus and the switch exhibits the first state, and the bracket is retractable into the apparatus after removal of the cable from the opening in the bracket to cause the switch to exhibit the second state.

9. The method according to claim 7, wherein the apparatus further comprises a battery compartment with a door to permit installation of a battery which powers the circuit in absence of AC power.

10. The method according to claim 7, wherein the switch further comprises a mechanical linkage responsive to the protrusion of the opening of the bracket from the apparatus to lock a door of a battery compartment of the apparatus so a battery of the apparatus cannot be removed.

11. The method according to claim 7, wherein the bracket includes a tab which protrudes from the apparatus to enable a user to pull the bracket out of the apparatus to expose the opening in the bracket.

12. The method according to claim 7, wherein responsive to a switch of the apparatus being in a first state and presence of AC power at a plug to indicate an armed state of the alarm, the circuit indicates an armed state of the alarm.

* * * * *